US005358322A

United States Patent [19]

McLaughlin

[11] Patent Number: 5,358,322

[45] Date of Patent: Oct. 25, 1994

[54] DRAWER LOCKING SYSTEM

[75] Inventor: Gordon McLaughlin, Beachburg, Canada

[73] Assignee: Krueger International, Inc., Green Bay, Wis.

[21] Appl. No.: 992,379

[22] Filed: Dec. 16, 1992

[51] Int. Cl.[5] ..... E05B 65/46

[52] U.S. Cl. ..... 312/219; 70/379 R; 70/78; 74/89.15; 74/109; 74/89.17

[58] Field of Search ..... 312/219, 218, 217, 216; 70/116, 120, 123, 379 R, 81, 78; 292/51; 74/89.15, 109, 89.17

[56] References Cited

U.S. PATENT DOCUMENTS

| | | | |
|---|---|---|---|
| 470,673 | 3/1892 | Heath . | |
| 1,277,412 | 9/1918 | Hardart, Jr. . | |
| 2,637,196 | 5/1953 | Seaver et al. | 70/379 R |
| 2,828,177 | 3/1958 | Johnson . | |
| 2,839,322 | 6/1958 | Kirk . | |
| 3,175,873 | 3/1965 | Blomquist et al. . | |
| 3,297,376 | 1/1967 | Barstow | 312/219 |
| 3,511,549 | 5/1970 | Macaluso . | |
| 3,521,937 | 7/1970 | Buhrmaster et al. . | |
| 3,767,280 | 10/1973 | McLaughlin . | |
| 3,776,007 | 12/1973 | Himsl . | |
| 3,883,200 | 5/1975 | Latham . | |
| 3,888,558 | 6/1975 | Himsl . | |
| 3,991,595 | 11/1976 | Bahry et al. . | |
| 4,239,309 | 12/1980 | De Fouw et al. . | |
| 4,246,769 | 1/1981 | McLaughlin . | |
| 4,429,930 | 2/1984 | Blouin . | |
| 4,453,787 | 6/1984 | Staropoli . | |
| 4,457,569 | 7/1984 | Scheerhorn . | |
| 4,609,233 | 9/1986 | Walla . | |
| 4,662,689 | 5/1987 | Chatterson et al. . | |
| 4,976,403 | 12/1990 | Bramblet | 74/109 X |
| 5,107,692 | 4/1992 | Chen | 70/209 |

FOREIGN PATENT DOCUMENTS

| | | |
|---|---|---|
| 831723 | 3/1960 | United Kingdom . |

*Primary Examiner*—Clifford D. Crowder
*Assistant Examiner*—Paul C. Lewis
*Attorney, Agent, or Firm*—Andrus, Sceales, Starke & Sawall

[57] ABSTRACT

A lock system for an article of furniture such as a cabinet or pedestal having one or more drawers or doors includes a lock bar movable between locked and unlocked positions responsive to an actuator and operating mechanism. The actuator and operating mechanism includes a lead screw which provides front-rear movement of a slider to which a toothed rack is mounted, in response to key operation of the lock mechanism by an operator. A toothed pinion is engaged with the toothed rack, and is rotatable in response to the front-rear movement of the rack. A pair of shafts are mounted to and rotatable with the pinion, extending between the pinion and a pair of levers mounted one on each side of the cabinet. Each lever is pivotably mounted, and includes an arm for lifting and lowering the lock bar in response to rotation of the shaft.

16 Claims, 3 Drawing Sheets

DRAWER LOCKING SYSTEM

BACKGROUND AND SUMMARY

This invention pertains to a lock system for an article of furniture such as a file cabinet, desk pedestal or the like having one or more drawers or self-storing doors in a stacked arrangement.

In a drawer locking system, it is common to provide a lock bar which is mounted to the structure of the cabinet for vertical movement between a locked position and an unlocked position. The lock bar includes locking studs or the like which move vertically during vertical movement of the lock bar, and the studs are movable into and out of engagement with slots formed in lock brackets mounted to the drawers.

Many prior art lock systems are known for providing vertical movement of the lock bar between its drawer locked and drawer unlocked positions in response to key-operated rotating movement of an actuator mechanism. Some such systems include a bevel gear arrangement for imparting vertical movement to the lock bar. While this type of arrangement operates satisfactorily, it is time-consuming and expensive to assemble, and requires extremely close tolerances in assembly in order to insure proper operation. Other such systems including very complex mechanisms having numerous moving parts, which again are difficult to assemble and require close manufacturing tolerances.

It is an object of the present invention to provide a lock system which is relatively simple in its construction and operation. It is a further object of the invention to provide such a lock system which is relatively easy to assemble, thereby reducing installation time. It is a further object of the invention to provide a lock system in which close manufacturing tolerances are not required, yet which nonetheless provides reliable and highly satisfactory operation.

The invention is used in connection with an article of furniture, such as a file cabinet, drawer pedestal or the like, having a front, a back and a pair of spaced sides. The article of furniture further includes at least one drawer or door and a movable lock member selectively movable between a locked position and an unlocked position.

In accordance with one aspect of the invention, a lock system for such an article of furniture includes a rotatable operator-controlled actuator mechanism mounted toward the front of the article of furniture; a pivotable lifting and lowering mechanism interconnected with the lock member for vertically moving the lock member between its locked and unlocked positions; and an operating mechanism interposed between the actuator member and the lifting and lowering mechanism for pivotably moving the lifting and lowering mechanism in response to rotation of the actuator member. The operating mechanism includes a first member interconnected with the actuator member, and an arrangement for converting rotation of the actuator member into linear movement of the first member along a front-rear axis. The lifting and lowering mechanism is interconnected with the first member, and is pivotable in response to the front-rear linear movement of the first member to provide vertical movement of the locking member between its locked and unlocked positions. The arrangement for converting rotation of the actuator member into linear movement of the first member includes a lead screw interposed between the actuator member and the first member. The actuator member is mounted for rotation within a barrel having an open end, and the lead screw includes a head disposed within the barrel and extending through its open end. A key shaft is mounted between the actuator member and the head of the lead screw from imparting rotation to the lead screw in response to rotation of the actuator member. The first member, which is movable in a front-rear direction, includes a threaded socket within which the threaded portion of the lead screw is received. The operating mechanism further includes a toothed rack member mounted to the socket for front-rear movement along with the socket in response to rotation of the lead screw, a rotatable toothed pinion having teeth which mesh with those of the toothed rack member, and a shaft extending between and interconnecting the pinion with the pivotable lifting and lowering mechanism.

In accordance with another aspect of the invention, a panel is mounted within the article of furniture adjacent the drawer, and a surface of the lock member is adjacent to and facing the panel. A locking stud is mounted to the lock bar, extending through a slot formed in the panel for movably mounting the lock bar to the panel. A lever is pivotably mounted to the panel and interconnected with the lock bar. Pivoting movement of the lever causes movement of the lock bar between its locked and unlocked positions. An operator-controlled actuator and operating mechanism, as summarized above, is interconnected with the lever for selectively imparting pivoting movement to the lever. The lever is mounted to the panel by means of a pin which defines the pivot axis of the lever, with the pin being received within an opening formed in the panel. The lever includes a first arm extending outwardly from the pin and terminating in an outer end, and a second arm extending from the outer end of the first arm along an axis substantially parallel to the pivot axis of the lever as defined by the pin. The second arm is engaged within a slot formed in the lock member, and is provided with an enlarged head which functions to retain the second arm within the slot. The opening formed in the panel, within which the pin is received, is also in the form of a slot extending along a longitudinal axis substantially perpendicular to the longitudinal axis of the lock bar. The lever further includes structure defining an internal passage within which the shaft associated with the actuator and operating mechanism is received, with the shaft being pivotable in response to the actuator and operating mechanism for selectively imparting pivoting movement to the lever.

The invention further contemplates a method of mounting the lock member and the pivotable lever to the article of furniture, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
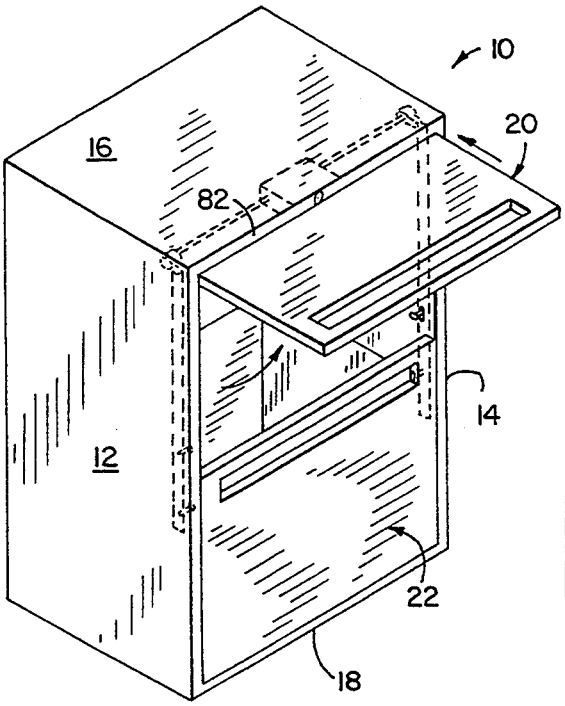
FIG. 1 is an isometric view of a file cabinet having a self-storing door and incorporating the lock system of the present invention, showing the self-storing door in its open position.
Figure 2:
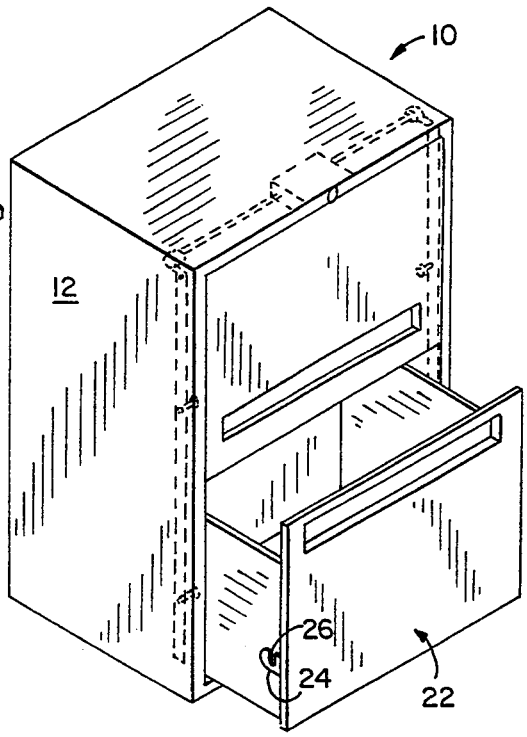
FIG. 2 is a view similar to FIG. 1, showing a drawer associated with the cabinet in its open position.

FIGS. 1 and 2 illustrate a cabinet, shown generally at 10, into which the lock system of the present invention is incorporated. Cabinet 10 includes a pair of side walls 12, 14, and upper wall 16 and a lower wall 18.

Cabinet 10 as illustrated is in the form of a file cabinet having an upper self-storing door 20 and a lower drawer 22. In a manner as is known, upper self-storing door 20 is pivotably hinged at its upper end for movement between its open position as shown in FIG. 1 and its closed position as shown in FIG. 2. When door 20 is in its open position of FIG. 1, door 20 can be pushed inwardly for storage within the upper portion of cabinet 10. Drawer 22 is mounted in any satisfactory manner to cabinet 10 for movement between its closed position as shown in FIG. 1 and its open position as shown in FIG. 2.

While the drawings illustrate a file cabinet having a drawer and a self-storing door, it is understood that the lock system of the present invention can be employed in any article of furniture having any number or combination of doors and/or drawers or other movable components.

Figures 3, 8:
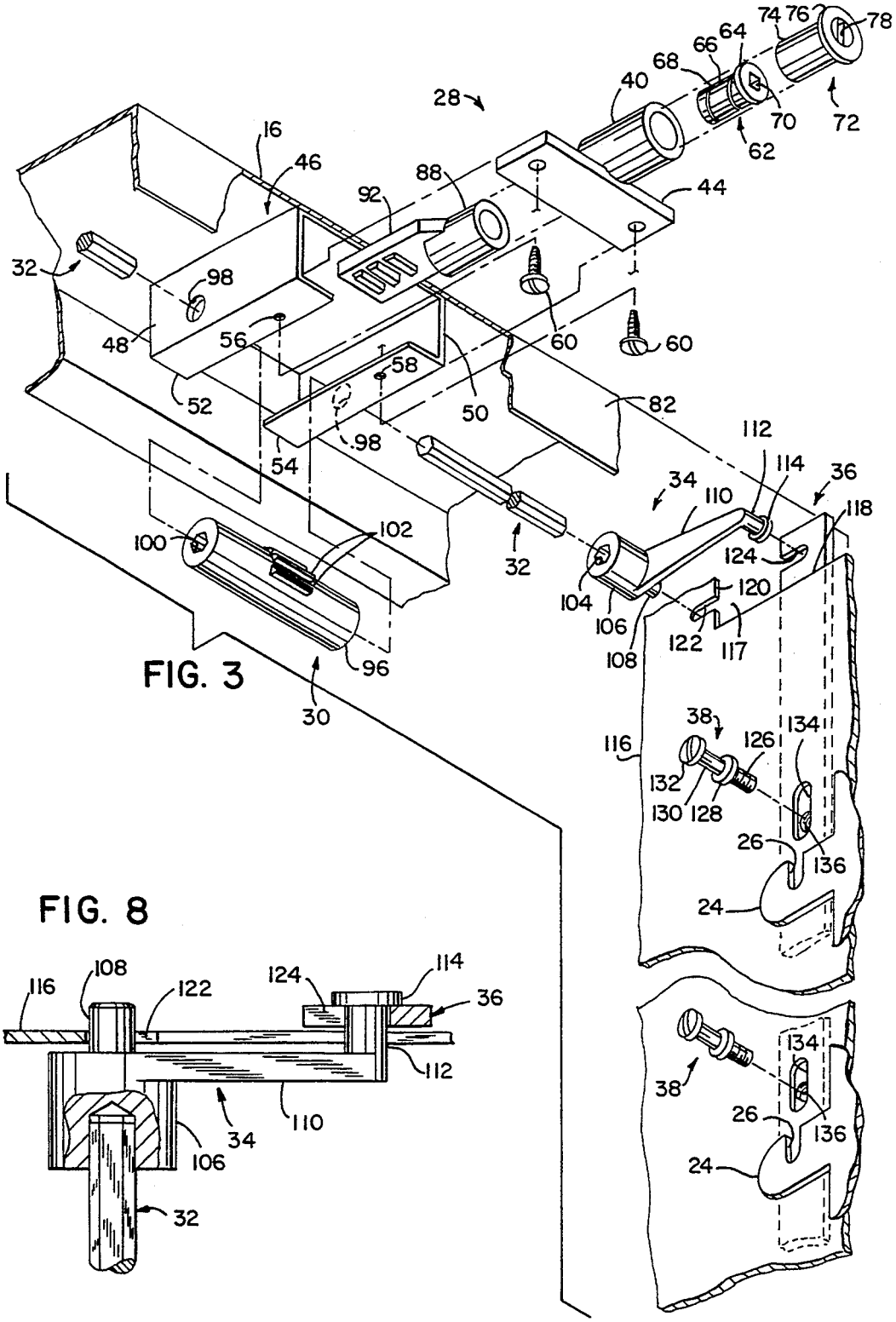
FIG. 3 is a partial exploded perspective view showing the components of the lock system of the invention adapted for assembly on one side of the file cabinet of FIG. 2.
FIG. 8 is a partial section view taken along line 8—8 of FIG. 6.

As shown in FIG. 2, a lock bracket 24 defining a slot 26 is mounted to the front panel of drawer 22, extending rearwardly therefrom along the side wall of drawer 22. A similar lock bracket is mounted to the opposite side of drawer 22. In addition, a lock bracket such as 24 is installed on each side of upper self-storing door 20. FIG. 3 illustrates lock brackets 24, each having a slot 26. The upper one of lock brackets 24 is mounted to the right side of door 20, and the lower one of lock brackets 24 is mounted to the right side of drawer 22.

FIG. 3 further illustrates the lock system according to the invention for use in locking and unlocking door 20 and drawer 22. Generally, the lock system of the invention includes an actuator and operating mechanism, the components of which are generally shown at 28; a pinion 30; a pair of shafts 32; a pair of levers, one of which is shown at 34; a pair of lock bars, one of which is shown at 36; and a series of studs, such as shown at 38.

In the drawing figures, only the components of the locking system on the side of cabinet 10 adjacent side wall 14 are illustrated. It is understood that identical components are mounted to cabinet 10 adjacent side wall 12.

Figure 4:
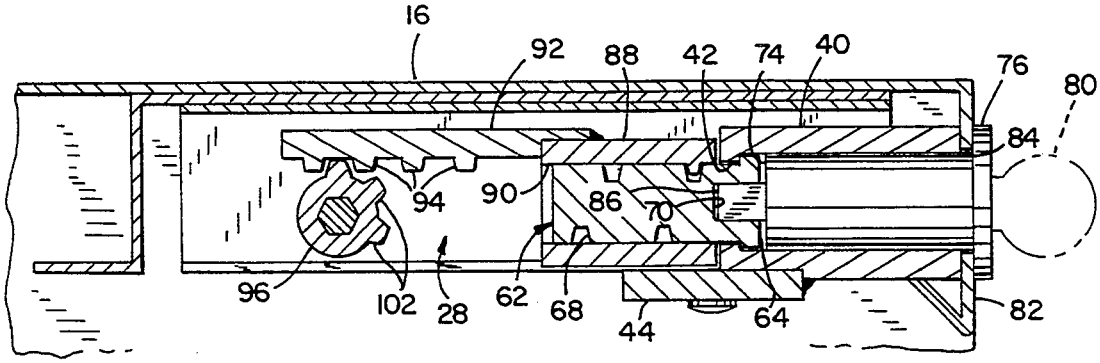
FIG. 4 is a partial section view showing the assembled actuator and operating mechanism of the lock system of FIG. 3, illustrated in a locked position.

Referring to FIGS. 3 and 4, actuator and operating mechanism 28 includes a cylindrical barrel 40 defining an internal passage. An opening 42 (FIG. 4) is formed in the end of barrel 40. Barrel 40 is mounted to a plate 44 having a pair of openings at its opposite ends. Barrel 40 is received within a channel-shaped bracket 46 mounted to the underside of cabinet upper wall 16 in any satisfactory manner, such as by spot welding or the like. Bracket 46 includes a pair of side walls 48, 50 and a pair of lower walls 52, 54. An opening 56 is formed in lower wall 52, and an opening 58 is formed in lower wall 54. The openings in plate 44 align with openings 56, 58 in bracket lower walls 52, 54, respectively, and threaded screws 60 extend through openings 56, 58 and into the openings in plate 44 to mount plate 44 and barrel 40 within the interior of bracket 46.

A lead screw 62 is mounted within the internal passage defined by barrel 40. Lead screw 62 includes a head 64 and a shank 66 having a helical slot defining lead threads 68. Lead screw 62 is inserted into the passage defined by barrel 40 such that its head 64 engages the shoulder defined by opening 42 in the end of barrel 40, with shank 66 extending outwardly from barrel 40. As shown in FIGS. 3 and 4, an irregular D-shaped passage 70 is formed in lead screw 62 extending inwardly into lead screw shank 66 from head 64.

An actuator member 72 includes a cylindrical body 74 and a front ring 76. Body 74 is rotatably mounted to front ring 76, and includes a key slot 78 for receiving a key, shown in phantom at 80 in FIGS. 4 and 5. Cylindrical body 74 is mounted for pivoting movement relative to ring 76. Referring to FIGS. 3 and 4, cylindrical body 74 is received within the internal passage defined by barrel 40. Cabinet 10 includes a narrow transverse upper wall 82 (FIGS. 1, 3, 4) within which an opening 84 is formed, through which cylindrical body 74 of actuator member 72 extends. Ring 76 is non-rotatably fixed to wall 82 in any satisfactory manner as is known in the art.

An irregular D-shaped key shaft 86 (FIGS. 3, 4) extends from the inner end of cylindrical body 74 of actuator member 72. Key shaft 86 may be formed integrally with cylindrical body 74 or alternatively may fit into a mating opening extending inwardly into body 74 from its outer end. Key shaft 86 is received within D-shaped passage 70 extending inwardly into lead screw 62 from its head 64. In this manner, operation of key 80 to rotate body 74 is transferred through key shaft 86 to lead screw 62. The D-shape of key shaft 86 and passage 70 provides exact orientation between actuator member 72 and lead screw 62.

Actuator and operating mechanism 28 further includes a cylindrical slider 88 defining an internally threaded passage 90, and a rack 92 having teeth 94 mounted to and extending rearwardly from slider 88. The threads in internally threaded passage 90 of slider 88 engage lead screw threads 68.

A pinion 96 is pivotably mounted between side walls 48, 50 of bracket 46. Referring to FIG. 3, hexagonal shafts 32 extend through openings 98 formed in side walls 48, 50 and into a hexagonal passage, such as shown at 100, extending inwardly from each end of pinion 96. This arrangement functions to mount pinion 96 for pivoting movement between bracket side walls 48, 50.

Figure 5:
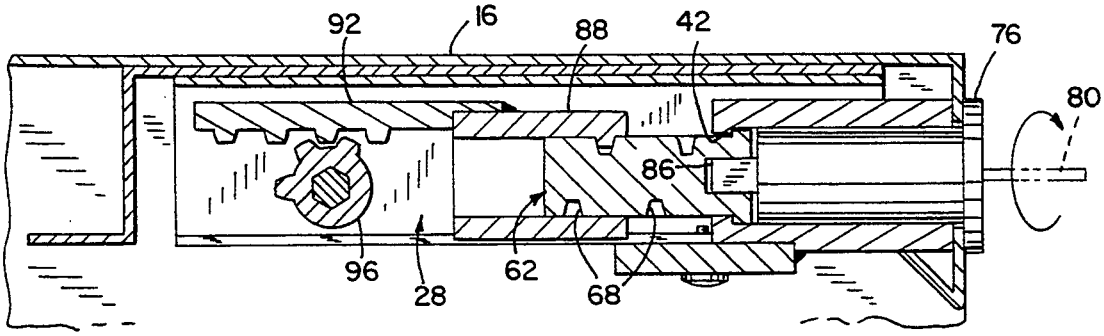
FIG. 5 is a view similar to FIG. 4, showing the mechanism in its unlocked position.

Pinion 96 further includes a series of teeth 102. Pinion teeth 102 engage rack teeth 94 when the components of actuator and operating mechanism 28 are assembled, as shown in FIGS. 4 and 5.

In operation, actuator and operating mechanism 28 functions as follows. When key 30 is inserted into key slot 78 and turned from its FIG. 4 position to its FIG. 5 position, the rotation imparted to lead screw 62 causes rearward movement of slider 80 and rack 92 within the interior of bracket 46, as shown. Engagement of rack teeth 94 with pinion teeth 102 results in counterclockwise pivoting movement of pinion 96, resulting in pivoting movement of shafts 32. Likewise, when key 80 is returned from its FIG. 5 position to its FIG. 4 position, actuator and operating mechanism 28 functions in reverse to pivotably rotate shafts 32 in a clockwise direction.

The end of each shaft 32 is mounted within a hexagonal passage 104 extending inwardly from the end of a cylindrical body 106 provided on lever 34. A pin 108 extends from the opposite end of body 106. Lever 34 further includes a first arm 110 extending outwardly from body 106 perpendicular to the longitudinal axis of body 106, along which passage 104 and pin 108 extend. First arm 110 terminates in an outer end, and a second arm 112 extends from the outer end of first arm 110. Second arm 112 extends along an axis perpendicular to arm 110, and thus is oriented parallel to the longitudinal axis of body 106 along which passage 104 and pin 108 lie. An enlarged head 114 is provided at the outer end of second arm 112.

A panel 116 is mounted within the interior of cabinet 10, spaced slightly inwardly from side wall 14. A similar panel is mounted on the opposite side of cabinet 10 adjacent side wall 12. Panel 116 includes an upper cutout area or opening 117 defining a horizontal edge 118 and a vertical edge 120. A slot 122 extends from vertical edge 120, terminating in a rounded inner end. Slot 122 defines a transverse dimension slightly larger than the diameter of pin 108 of lever 34, so that pin 108 can be received within slot 122.

A slot 124 is provided toward the upper end of lock bar 36. Slot 124 has a width slightly greater than the diameter of second arm 112 of lever 34, so that second arm 112 can be received within slot 124. Slots 122, 124 extend substantially parallel to each other.

The interconnection of lever 34 with panel 116 and lock bar 36 is illustrated in detail in FIG. 8.

Figure 9:
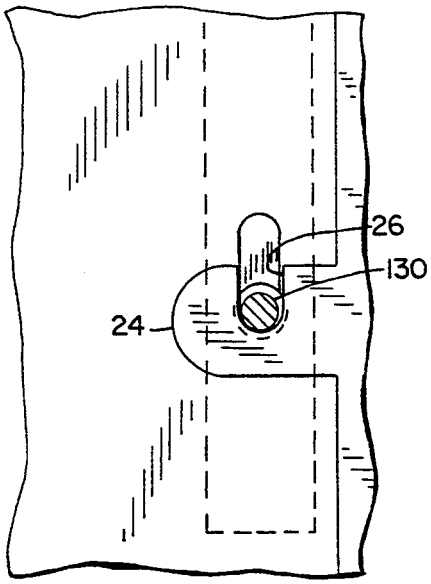
FIG. 9 is a partial section view taken along line 9—9 of FIG. 6.
Figure 9:
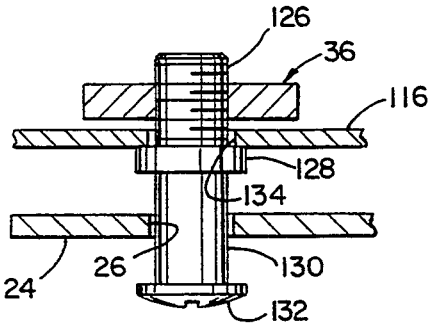

Referring to FIGS. 3 and 9, each of studs 38 includes a threaded end 126, a shoulder 128, a shank 130 and a head 132. Panel 116 defines vertical slots 134, and lock bar 36 is provided with internally threaded openings 136 in alignment with vertical slots 134. Threaded end 126 of each stud 38 extends through a slot 134, and is threadedly engaged with threaded opening 136 formed in lock bar 36. Shoulder 128 of each stud 38 engages panel 116 adjacent slot 134. With this arrangement, lock bar 36 is mounted for vertical movement to panel 116, with the range of movement of lock bar 36 being defined by the upper and lower extent of each of slots 134.

Parallel slots 122, 124 formed in panel 116 and lock bar 36, respectively provide simple installation of lever 34 and lock bar 36 by engagement of pin 108 within slot 122 and second arm 114 within slot 124. Once studs 38 are installed by threaded end 126 of each stud 38 being received within one of threaded openings 136 formed in lock bar 36, lock bar 36 and lever 34 are securely engaged with each other and with panel 116.

As shown in FIGS. 3 and 9, lock brackets 24 are positioned such that their slots 26 are in vertical alignment with stud shank portions 130 when door 20 and drawer 22 are in their closed positions.

Figure 6:
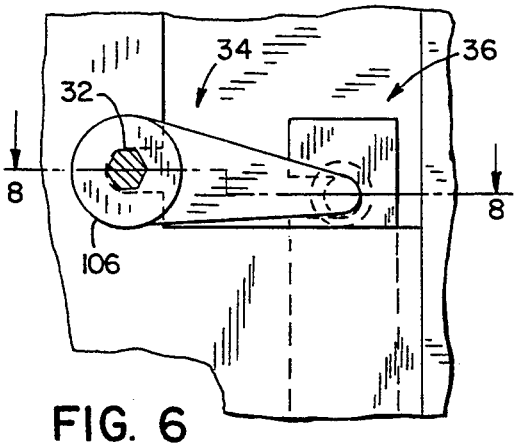
FIG. 6 is a partial side elevation view of the lever and lock bar subassembly associated with the lock system of FIG. 3, showing the lock bar in its locked position.
Figure 7:
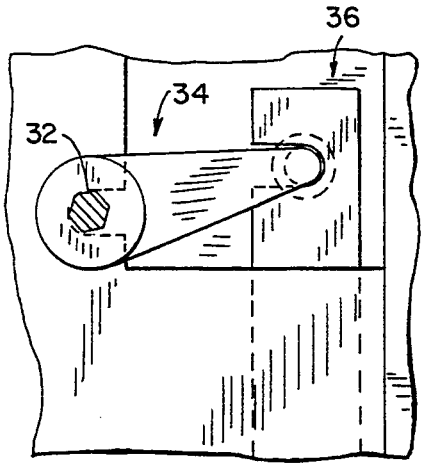
FIG. 7 is a view somewhat similar to FIG. 6, showing the lock bar in its unlocked position.
Figure 7:
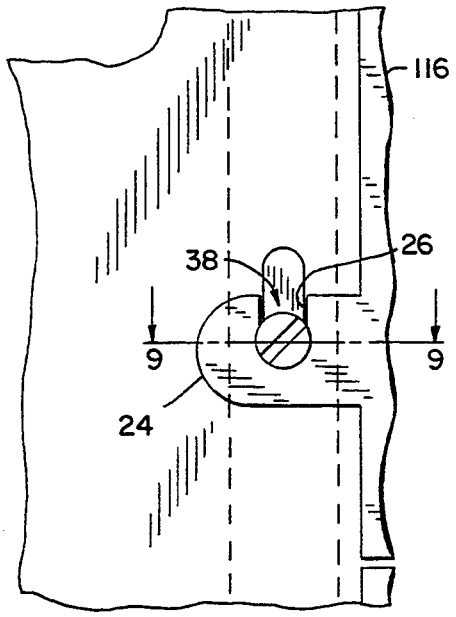
Figure 7:
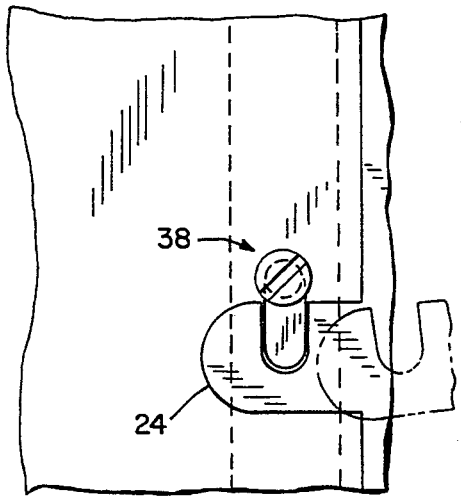

Operation of actuator and operating mechanism 28, as described above, functions to move levers 34 at the ends of rods 32, and lock bars 36, between the position shown in FIG. 6 and the position shown in FIG. 7. The FIG. 6 position of each lever 34 and each lock bar 36 is attained when key 80 is operated to move actuator and operating mechanism 28 to its FIG. 4 position. In this position, slider 88 and rack 92 are drawn forwardly to rotate pinion 96 and shaft 32 in a clockwise direction. This results in pivoting counterclockwise movement of lever 34 about its pin 108 to its FIG. 6 position, to move lock bar 36 vertically downwardly. The shank portion 130 of each stud 38 is then received within slot 26 of each lock bracket 24, to prevent door 20 and drawer 22 from being opened. When key 80 is turned to move slider 88 and rack 92 rearwardly thus rotating shafts 32 counterclockwise, each lever 34 is pivoted to its FIG. 7 position to vertically lift lock bar 36. This unlocks door 20 and drawer 22 by moving studs 38 upwardly so that the shank 130 of each stud 38 is removed from lock bracket slots 26. Door 20 and drawer 22 can thus be opened and closed without interference from studs 38.

The locking mechanism of the present invention, as shown and described, provides a relatively simple system providing highly advantageous operation and assembly. For instance, the construction of actuator and operating mechanism 28 is very easy to assemble and provides manufacturing and installation tolerances less exacting than prior art lock systems, such as those employing bevel gears or the like. In addition, if it is desired to increase or decrease the throw of the lock system, i.e. the amount key 80 must be rotated to move the lock system between its locked and unlocked positions, all that must be done is to alter the pitch of threaded slot 68 of lead screw 62 and the corresponding pitch of the internal threads of slider member 88. Further, the manner in which levers 34 are mounted to panel 116 and lock bar 36 provides a simple and efficient assembly and method of installing levers 34.

Various alternatives and embodiments are contemplated as being within the scope of the following claims particularly pointing out and distinctly claiming the subject matter regarded as the invention.

I claim:

1. A lock system for an article of furniture having a front, a back and a pair of spaced sides, at least one movable component mounted to the article of furniture for movement between an open position and a closed position, and a vertically movable lock member selectively movable between a locked position and an unlocked position, the lock system comprising:

a rotatable operator-controlled actuator member mounted toward the front of the article of furniture;

a pivotable lifting and lowering mechanism interconnected with the vertically movable lock member for moving the lock member between its drawer locked and drawer unlocked positions; and an operating mechanism interposed between the actuator member and the lifting and lowering mechanism for vertically moving the lifting and lowering mechanism in response to rotation of the actuator member, the operating mechanism including a first member interconnected with the actuator member, and an arrangement for converting rotation of the actuator member into linear movement of the first member along a front-rear axis;

wherein the lifting and lowering mechanism is interconnected with the first member and is pivotable in response to the front-rear linear movement of the first member to provide vertical movement of the locking member between its locked and unlocked positions.

2. The lock system of claim 1, wherein the arrangement for converting rotation of the actuator member into linear movement of the first member along a front-rear axis comprises a lead screw member interposed between the actuator member and the first member.

3. The lock system of claim 2, further comprising a barrel within which the actuator member is mounted for rotation, the barrel defining an open inner end, and wherein the lead screw member includes a head disposed within the barrel for mounting the lead screw member to the barrel.

4. The lock system of claim 3, further comprising a key shaft mounted between and interconnecting the actuator member and the head of the lead screw member for imparting rotation to the lead screw member in response to rotation of the actuator member.

5. The lock system of claim 2, wherein the first member includes a threaded socket within which the threaded portion of the lead screw member is received, wherein linear front-rear movement of the first member is imparted in response to movement of the socket upon rotation of the lead screw member.

6. The lock system of claim 5, further comprising:

a toothed rack member mounted to the socket for front-rear movement along with the socket in response to rotation of the lead screw member;

a rotatable toothed pinion, wherein the teeth of the pinion mesh with the teeth of the toothed rack, whereby rotation is imparted to the pinion in response to front-rear movement of the toothed rack; and a shaft extending between and interconnecting the pinion and the lifting and lowering mechanism.

7. The lock system of claim 2, wherein the lifting and lowering mechanism comprises a lever pivotable in response to rotation of a shaft associated with the operating mechanism.

8. The lock system of claim 7, further comprising a panel located within the interior of the article of furniture adjacent one of its sides, wherein the lock member comprises a lock bar having one of its surfaces adjacent to and facing the panel, and further comprising a locking stud mounted to the lock bar and extending through a slot formed in the panel for movably mounting the lock bar to the panel, and wherein the lever is mounted for pivoting movement to the panel.

9. A lock system for an article of furniture having a front, a back and a pair of spaced sides, and at least one movable component mounted to the article of furniture for movement between an open position and a closed position, comprising:

a panel mounted adjacent the movable component, the panel including an opening and a first traverse slot extending therefrom;

a movable lock bar located adjacent the panel and including a portion located within the panel opening having a second transverse slot, wherein the lock bar is selectively movable between a locked position and an unlocked position for selectively locking and unlocking the movable component when in its closed position;

a lever interposed between the panel and the lock bar, wherein the lever includes a first pin extending into the first slot in the panel for pivotably mounting the lever to the panel, the first pin defining the pivot axis of the lever, and a second pin extending into the second slot in the lock bar for mounting the lever to the lock bar, wherein pivoting movement of the lever causes movement of the lock bar between its locked and unlocked positions; and an operator-controlled actuator and operating mechanism interconnected with the lever for selectively imparting pivoting movement to the lever.

10. The system of claim 9, wherein the first and second slots are substantially parallel and are both oriented substantially transverse to the longitudinal axis of the lock bar.

11. The system of claim 9, wherein the second slot opens onto an edge of the lock bar, and wherein the first and second slots open toward each other.

12. The system of claim 9, wherein the second slot opens onto an edge of the lock bar, and wherein the lever includes an enlarged head portion which engages a surface of the lock bar for retaining the lever in engagement with the lock bar.

13. A method of mounting a pivotable lever of a locking mechanism to an article of furniture, the article of furniture having a movable lock bar selectively movable between a locked position and an unlocked position, comprising the steps of:

mounting a panel adjacent a movable component of the article of furniture, the panel including an opening and a transverse slot extending from the opening;

locating the lock bar adjacent the panel such that a portion of the lock bar extends into the panel opening;

forming a transverse slot in the lock bar;

pivotably mounting a lever to the panel by engaging a first pin associated with the lever into the panel slot; and engaging the lever with the lock bar by engaging a second pin associate with the lever with the lock bar slot.

14. The method of claim 13, wherein the step of forming a slot in the lock bar comprises forming the lock bar slot such that it extends inwardly from an edge of the lock bar and opens in a direction facing the opening of the panel slot into the panel opening.

15. The method of claim 14, further comprising the step of providing an enlarged head on the second pin of the lever for engaging a surface of the lock bar to retain the lever in engagement with the lock bar.

16. A lock system for an article of furniture having a front, a back and a pair of spaced sides, at least one movable component mounted to the article of furniture for movement between an open position and a closed position, and a movable lock bar selectively movable between a locked position and an unlocked position, the lock system comprising:

a rotatable operator-controlled actuator member mounted toward the front of the article of furniture;

an axially extending shaft defining first and second ends;

a lever interconnected with the first end of the shaft and with the movable lock bar; and an operating mechanism interconnected with the second end of the shaft and with the actuator member for imparting pivoting movement to the shaft in response to operator-controlled rotation of the actuator member, the operating mechanism including a first member movable in a front-rear direction in response to rotation of the actuator member, and a pivotable second member, to which the second end of the shaft is mounted, wherein the pivotable second member is pivotably movable in response to front-rear movement of the first member.

* * * * *